US005199195A

United States Patent [19]

Scordilis et al.

[11] Patent Number: 5,199,195

[45] Date of Patent: Apr. 6, 1993

[54] ARTICULATED TOOTHED EXCAVATING APPARATUS

[76] Inventors: Frank P. Scordilis, 4355 Conrad Dr., Spartanburg, S.C. 29301; Andreas Scordilis, 73 Pinetree Ct., Inman, S.C. 29349

[21] Appl. No.: 722,967

[22] Filed: Jun. 28, 1991

Related U.S. Application Data

[63] Continuation-in-part of Ser. No. 607,868, Nov. 2, 1990, abandoned, which is a continuation of Ser. No. 418,487, Oct. 10, 1989, abandoned.

[51] Int. Cl.[5] ..... E02F 5/04; E02F 3/24

[52] U.S. Cl. ..... 37/350; 37/94; 37/91; 37/189; 37/364

[58] Field of Search ..... 37/109, 117.5, 142 R, 37/189, 81, 80 A, 249, DIG. 3, 91, 94

[56] References Cited

U.S. PATENT DOCUMENTS

| | | | |
|---|---|---|---|
| 1,790,758 | 2/1931 | Montano et al. . | |
| 1,818,887 | 8/1931 | Fairley . | |
| 2,481,679 | 9/1949 | Miller et al. . | |
| 3,148,917 | 9/1964 | Thompson | 37/189 X |
| 3,706,145 | 12/1972 | Bucksch et al. . | |
| 3,767,262 | 10/1973 | Pentith | 37/189 X |
| 3,862,539 | 1/1975 | Stevens . | |
| 3,982,339 | 9/1976 | Nilsson . | |
| 4,039,265 | 8/1977 | Dermond . | |
| 4,070,129 | 1/1978 | Moench, Sr. . | |
| 4,109,336 | 8/1978 | Ford . | |
| 4,428,131 | 1/1984 | Hahn | 37/142 R |
| 4,436,040 | 3/1984 | Chumley | 37/117.5 X |
| 4,549,648 | 10/1985 | Langner | 37/189 X |
| 4,699,543 | 10/1987 | Mio et al. . | |
| 4,712,320 | 12/1987 | Cartner | 37/189 X |
| 4,755,001 | 7/1988 | Gilbert . | |
| 4,786,111 | 11/1988 | Yargici . | |
| 4,793,732 | 12/1988 | Jordon . | |
| 4,819,348 | 4/1989 | DeBolt . | |
| 4,823,486 | 4/1989 | Diekevers et al. . | |
| 4,872,977 | 10/1989 | Jackson | 37/117.5 X |
| 4,878,713 | 11/1989 | Zanetis . | |

*Primary Examiner*—Randolph A. Reese
*Assistant Examiner*—J. Russell McBee
*Attorney, Agent, or Firm*—Dority & Manning

[57] ABSTRACT

An excavating device for scraping away the high shoulder material on the road sides. The device includes a rotating drum on which are permanently attached tooth-supports arranged in a helix. On the supports are fastened spikes and teeth, different types for different terrain. Scraped earthen material can be dispersed or windrowed and by arranging the supports on opposite helixes or by reversing rotation, the material can be dispersed or windrowed right or left of the rotating drum. A frame is employed to support the rotating drum, and the drum can be articulated to various working positions by hydraulic cylinders. A retractable hood is located above the rotor and movable deflectors are provided for material flow control. Tracer wheels facilitate control of the desirable digging depth.

16 Claims, 11 Drawing Sheets

ARTICULATED TOOTHED EXCAVATING APPARATUS

This application is a continuation-in-part of application Ser. No. 07/607,868, now abandoned, filed Nov. 2, 1990, which is a continuation of application Ser. No. 07/418,487, now abandoned filed Oct. 10, 1989.

BACKGROUND OF THE INVENTION

1. Field of the Invention

This invention relates to scraping and planing operations and in particular to the disposing of the high shoulder material usually formed on the roadside by rain-water, wind and vegetation erosion.

2. Description of the Background Art

Current shoulder scraping operations employ one or two motor graders, one force-feed loader, and a fleet of loading trucks to carry away the scraped material. Furthermore the forming of drainage gutters towards the ditch employs the use of one hydraulic excavator and one loading truck.

SUMMARY OF THE INVENTION

The present invention employs a drum with relatively high rotational speed that will not only throw the material sufficient distances towards the drainage ditch but it will also spread it evenly where it does not need to be picked up since it does not form an obstruction. Furthermore opposite rotation of the drum or use of an opposite helix drum and with the interposition of dirt deflectors, the invention will replace the motor grader(s) in the current scraping practice by windrowing the material, an operation that is necessary in densely inhabited areas, and when such dirt can be picked-up and/or used for regrading eroded road surfaces.

The present invention comprehends an improved method and apparatus for scraping away the earthen material and/or forming gutters towards the ditch, to provide an easier, low cost, relatively high speed operation of effective rain-water drainage off the road that greatly improves the life of the road surface and supporting road foundation layers from rain-water erosion and vegetation growth.

The invention comprehends a new method of scraping the road side high shoulder and/or forming drainage gutters perpendicular to the road axis towards the ditch, employing a rotating drum. A feature of the present invention is that it pulverizes the cut material.

A combination of teeth and carbide spikes (from now on called blades) are arranged onto this drum, supported by blade-holders that are welded or otherwise attached on the surface of the drum.

Depending upon the application as explained later, the arrangement of the blades on the drum forms a 2, 3 or 4 flight helix, left hand or right hand.

By rotating the drum and pressing it onto the ground, the operator is able to scrape away the high shoulder on the road-side and/or form drainage gutters towards the ditch.

Additionally, by counter-rotating the rotor, or by using a rotor with an opposite helix, the operator is able to windrow the scraped material to be picked up by a loader (or any other means), from the road-side. This application includes a retractable flap which diverts and holds the material flow.

The rotating drum or "rotor" is positioned to its working position by various means of articulation as shown in the attached drawings.

The transmission of power to the rotor is mechanical, (by means of a drive shaft, right-angle gearboxes and reduction or step-up gearboxes), or hydraulic, depending on the application and the carrier. The thickness of the scraped material can be kept constant by retractable tracer wheel(s) and floating hydraulic cylinder.

There are three main embodiments of the present invention: An implement version, a self-articulated version, and a trailer version. A self-propelled version is also within the scope of the invention.

The implement version is driven and positioned (articulated) by the carrier or prime mover: tractor, dozer, motor-grader, front-end loader, etc. Any carrier that can produce 60 to 100 horsepower at its power take off can be fitted with a scraper. Rear hitch-mount will be the standard version, with mid-mount and front-mount as options.

The self-articulated and trailer versions include a mechanical or hydraulic transmission from the carrier to the rotor. The carrier or prime mover shall provide the mechanical power to the input gearbox or hydraulic pump.

The following drawings show the main working parts in all versions.

The cantilever arrangement is initially designed only with 40" rotor due to weight limitations (large overhanging weight, shaft size, bearing loads, structural rigidity). Rotors of 60" to 100" may also be produced according to the present invention, as well as any other suitable rotor length.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification including reference to the accompanying figures in which.

Figure 1:
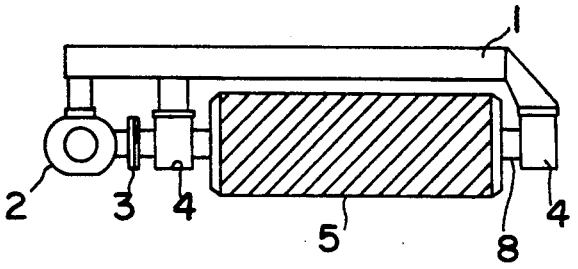
FIG. 1 is a front view of an implement version of the present invention.

Repeat use of reference characters in the present specification and drawings is intended to represent same or analogous features or elements of the invention.

DETAILED DESCRIPTION OF THE PREFERRED EMBODIMENTS

It is to be understood by those of ordinary skill in the art that the present discussion is a description of exemplary embodiments only, and is not limiting of the broader aspects of the present invention, which broader aspects are embodied in the exemplary constructions.

Referring to FIG. 1, an implement version of the present invention is disclosed including a 3-point hitch frame 1 made of heavy-duty square hollow section that connects the implement to the carrier. Usual carriers are tractors or tractor attachments. Front or mid-mounted implements have custom made frames depending on the carrier.

A right-angle reduction gearbox 2 that is attached to the frame is used to cope with the 90 degree direction change in rotation. In the case of a carrier with a hydraulic drive where a hydraulic motor is used to drive the scraper or rotor, element 3 is a flanged coupling or torque limiter. Overload protection is provided hydraulically (pressure relief valve). In the case of a mechanical drive, a torque-limiter is used either on the input drive-shaft that connects the PTO to item 2, or in the position of element 3.

Items 4 are pillow blocks with double-row spherical roller bearings that connect the shaft 8 and rotor 5 onto the base. Of course, any type bearing arrangement could be used that would adequately support the rotor for rotation.

Figure 1A:
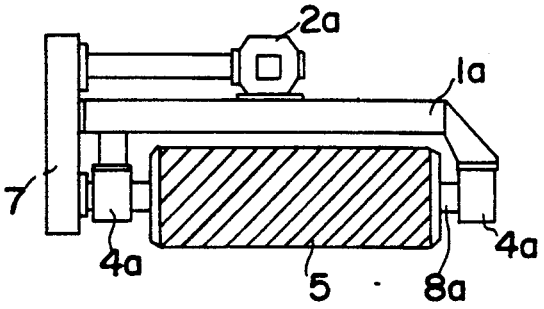
FIG. 1A is a front view of another embodiment of the implement version of FIG. 1.
Figure 1B:
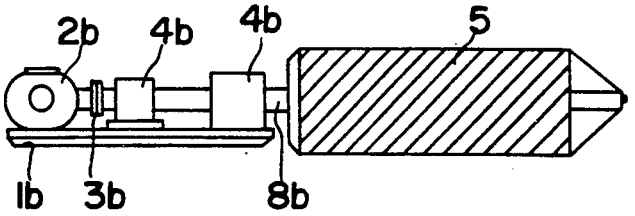
FIG. 1B is a front view of still another embodiment of the implement version of FIG. 1.

Item 5 in FIGS. 1, 1A, and 1B is the rotor. The rotor is easily detachable for quick replacement, if the application requires different rotors for the same carrier. The cutting blades on the rotor of this embodiment are either flat teeth or carbide picks or a combination of these, depending on the application.

FIG. 1A illustrates another embodiment of the implement version of the present invention as set forth in FIG. 1. As illustrated in FIG. 1A, element 1*a* is a 3-point hitch frame that can be constructed as set forth with regard to element 1 above. A right angle reduction gearbox 2*a* is attached to frame 1*a* to facilitate the 90 degree direction change in rotation of the input power source. In the case of a mechanical drive, a belt or chain reducer 7 transmits power from the right angle gearbox 2*a* to the rotor 5. Pillow blocks 4*a* support shaft 8*a* for rotation of rotor 5. Pillow blocks 4*a* may contain spherical roller bearings (FIG. 5) to facilitate rotation of rotor 5.

FIG. 1B illustrates another embodiment of an implement version of the apparatus of FIG. 1. As illustrated in FIG. 1B, element 1*b* represents a 3-point hitch frame for the implement. Right angle gearbox 2*b* is attached to frame 1*b* to facilitate the 90 degree direction change in rotation of the input power source. In the case of a carrier with a hydraulic drive where a hydraulic motor is used to drive the apparatus, element 3*b* is a torque limiter or flanged coupling. Overload protection is provided hydraulically (pressure relief valve). In the case of a mechanical drive, a torque limiter is used either on the input drive shaft that connects the power take-off to the gearbox 2*b* , or in the position of element 3*b*.

Elements 4*b* are pillow blocks with double row spherical roller bearings that attach the drive shaft 8*b* and rotor 5 to the frame 1*b*. Of course, any suitable bearing arrangement would be within the scope of the invention and double row spherical roller bearings are used here for illustration purposes only.

Figure 2:
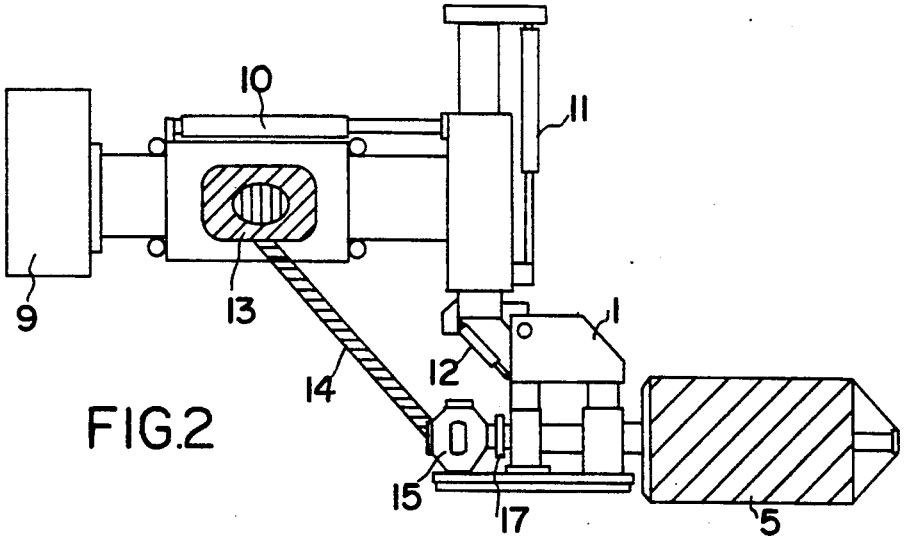
FIG. 2 is a front view of an articulated self-contained version of the present invention.
Figure 2A:
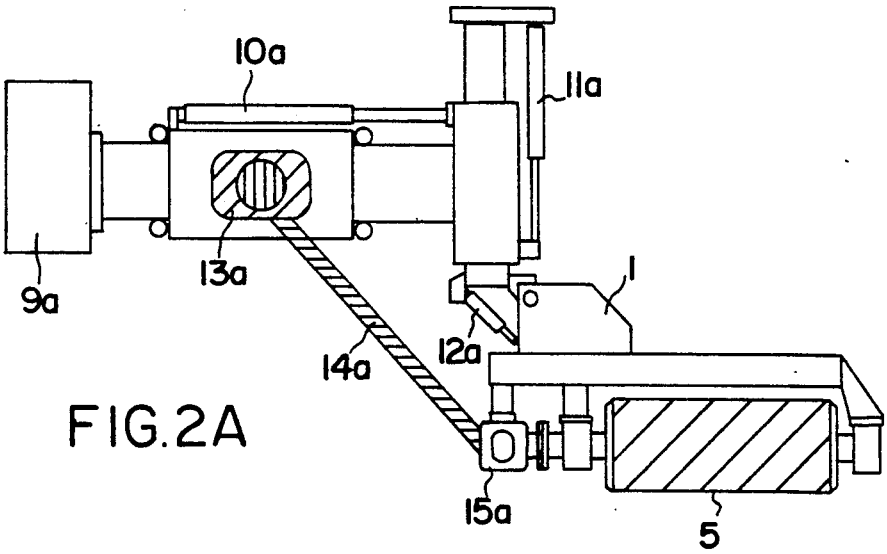
FIG. 2A is a front view of another embodiment of the articulated self-contained version of FIG. 2.

Referring to FIGS. 2 and 2A, articulated, self-contained versions of the present invention are illustrated. A main frame 1 made of heavy duty square hollow sections or other suitable material supports the scraper and connects it to the carrier.

This main frame 1 is either a 3-point hitch or mid-mount or front-mount, depending on the carrier.

In the case of a mechanical drive to the rotor 5 as illustrated in FIG. 2, item 9 is a counter-weight whose size depends on the rotor size. Cylinders 10, 11 and 12 provide articulation as illustrated. Cylinder 10 adjusts the lateral position of the rotor. Cylinder 11 adjusts the depth of cut of the rotor and cylinder 12 adjusts the angle of cut of the rotor. The cylinders may have 20" or 40" stroke or any stroke to provide desired articulation.

A right angle gearbox 13 drives a drive shaft 14 which in turn powers another gearbox 15 that drives the rotor 5. An overload device (clutch) 17 is employed in this transmission to protect the driving parts from shock loads.

In the case of a hydraulic drive as illustrated in FIG. 2A, item 9*a* is an oil-tank that acts as a counter-weight. Cylinders 10*a*, 11*a* and 12*a* provide articulation as discussed above with respect to cylinders 10, 11 and 12. Item 13*a* is a double hydraulic pump, whose larger section drives the rotor 5 through a hydraulic motor 15*a* and the smaller section operates the cylinders 10*a*, 11*a* and 12*a*. Hydraulic motor 15*a* may include a planetary reduction gearbox. Flexible hoses 14*a* connect pump 13*a* to the cylinders and to the hydraulic motor.

Figure 3:
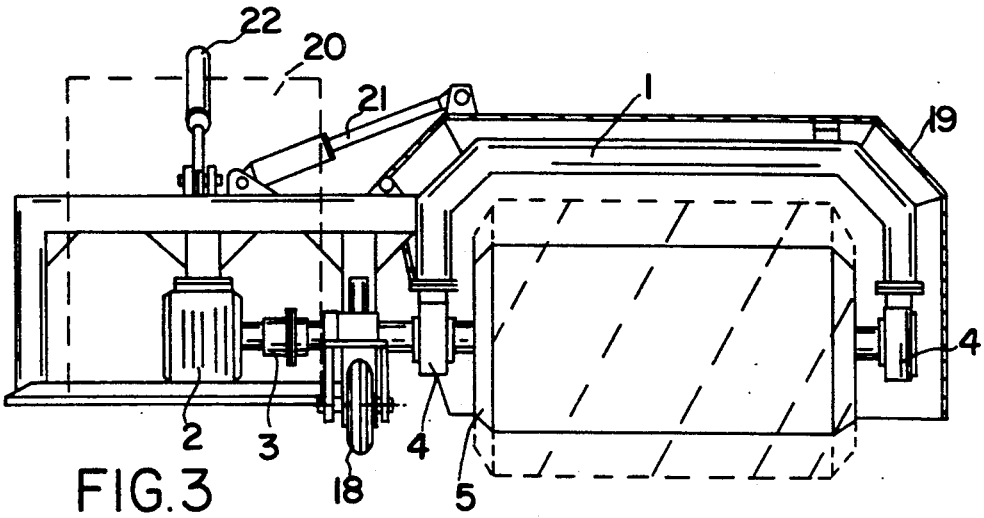
FIG. 3 is a more detailed front view of the embodiment of FIG. 1.

As illustrated in FIG. 3, a tracer wheel 18 adjusts the working depth of the rotor 5. To cope with road irregularities, cylinder 11 (FIG. 2) has a floating position.

Optional retractable flaps or direction panels 19 direct the flow of scraped material away from the road side, or gather it to be picked up by other equipment. In the case of a self-contained PTO driven hydraulic system, a step-up double output gearbox 13*a* (FIG. 2A) is used to drive two pumps, one for the articulation (not shown) and another to drive the rotor 5. A pressure relief valve protects the system from overloads or shock loads, and a flow regulator adjusts the rotor RPM.

In order to stack the material to be picked-up, the operator can either use a rotor 5 with an opposite helix (mechanical drive-implement versions), or reverse the rotation. This variation depends on the carrier capacity.

The number of helical flights, the helix angle and the rotor RPM, depend on the application.

As described, in operation, the implement version of FIGS. 1, 1A and 1B which is used as an attachment to any carrier (e.g., 540 rpm, 100 HP), consists of a frame 1 that supports the rotor 5 and connects the implement to the carrier. For driving the rotor, a right angle gearbox 2 is used, a coupling 3 and pillow blocks 4. In another layout, as illustrated in FIG. 1A, a right angle gearbox 2a is employed combined with a chain or a belt reducer 7.

The articulated, self-contained version as illustrated in FIGS. 2 and 2A provides its own articulation and the hydraulic system that articulates the particular parts is fully independent of the carrier hydraulic system. The items in FIG. 2 are described in more detail below.

Figure 4:
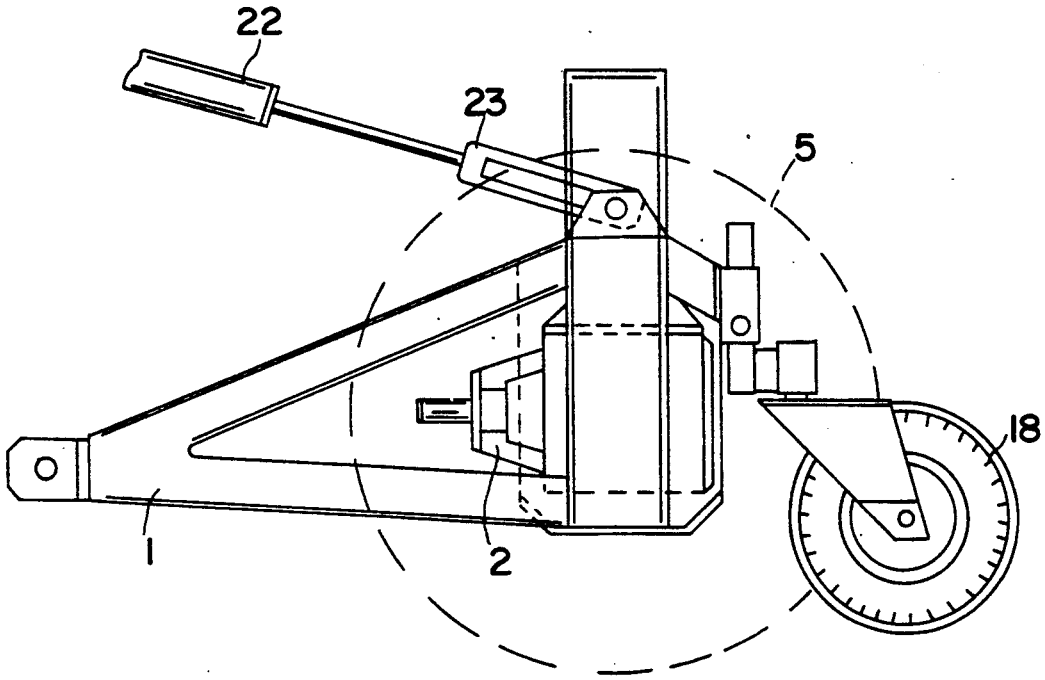
FIG. 4 is a partial side view of FIG. 3.

As illustrated in FIG. 3, item 20 denotes a carrier, item 1 a supporting frame, item 2 a right angle transmission, item 3 a coupling, item 4 the pillow blocks that contain spherical roller bearings, and item 5 the rotor. A hood item or flap 19 is employed to control the material flow and is retractable by means of cylinder 21. Cylinder 22 lifts the implement for transportation or positions it to working position. A slotted-ended cylinder rod 23 (FIG. 4) provides floating action and the working depth is controlled by the position of the tracer wheel 1B as illustrated in FIG. 4. It should be understood by one of ordinary skill in the art that any suitable bearing arrangement is within the scope of the present invention and spherical roller bearings are recited for illustration only.

Figure 5:
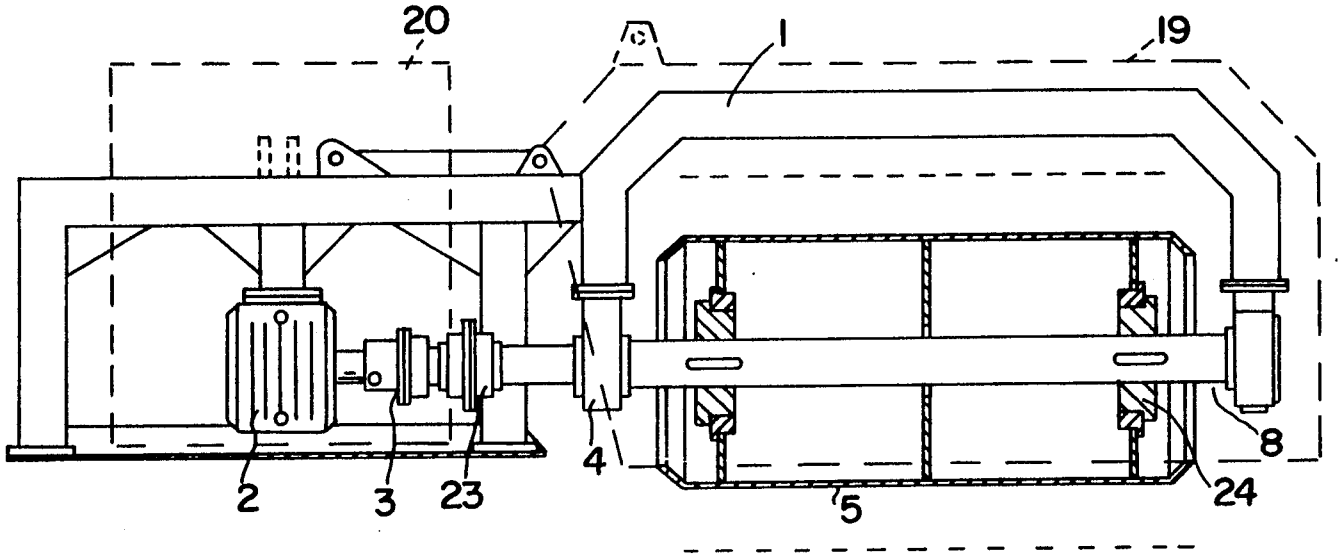
FIG. 5 is a cross-sectional view taken along the center of FIG. 3.

FIG. 5 illustrates the drive components. Item 20 is the carrier or prime mover, item 1 is the frame, item 2 the right angle transmission, items 3 and 23 are a flanged connection and a coupling that are employed for easier machine serviceability, items 4 are the pillow blocks, item 5 is the rotor, items 24 are split bushings that lock the rotor to the shaft 8 and item 19 is the retractable hood or flap.

Figure 6:
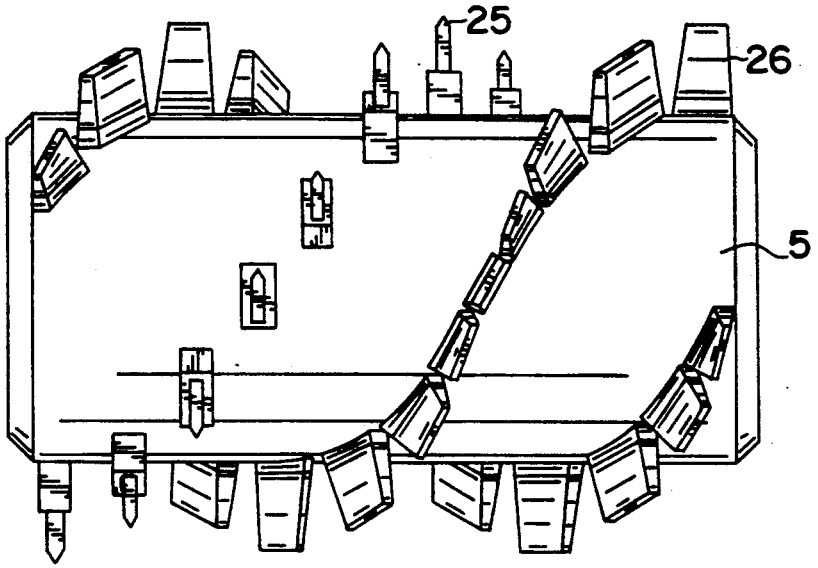
FIG. 6 is a detailed view of an embodiment of a rotor according to the present invention.
Figure 6A:
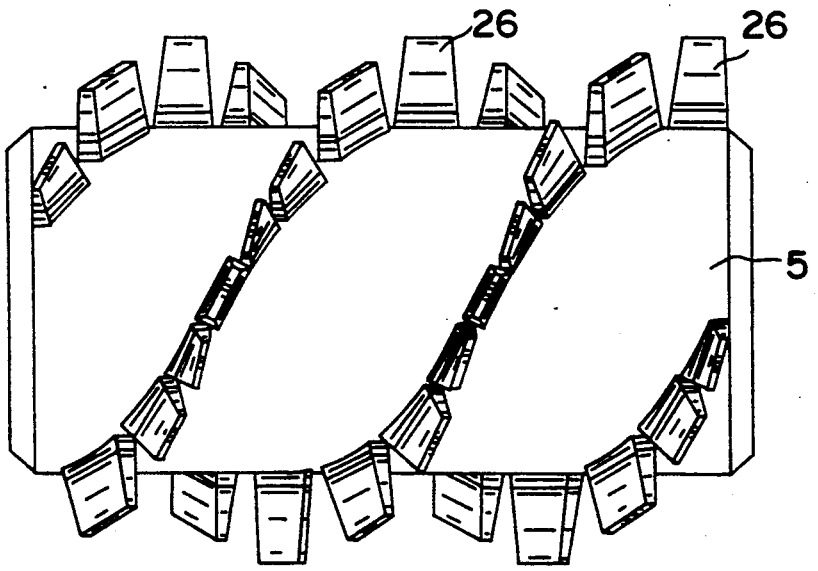
FIG. 6A is a detailed view of another embodiment of the rotor of FIG. 6.

FIG. 6 shows an arrangement of the carbide teeth 25 and flat blades 26 onto the drum. As described above, these blades are arranged in a 2 or 3 flight helix, left or right hand. Rotors (hereby the combination of drum and teeth) can be equipped with flat blades 26 only as in FIG. 6A when the machine is used in soft, sandy or muddy grounds, or with a combination of flat blades 26 and carbide teeth 25 when the machine is used in harder ground. However, in order for the screw principal to be effective, at least one of the helix flights must consist of flat blades 26. It was experimentally found that, in this embodiment, a rotor for general use should preferably include one row (flight) of carbide teeth 25 and two rows of flat blades 26, as shown in FIG. 6.

Figure 7:
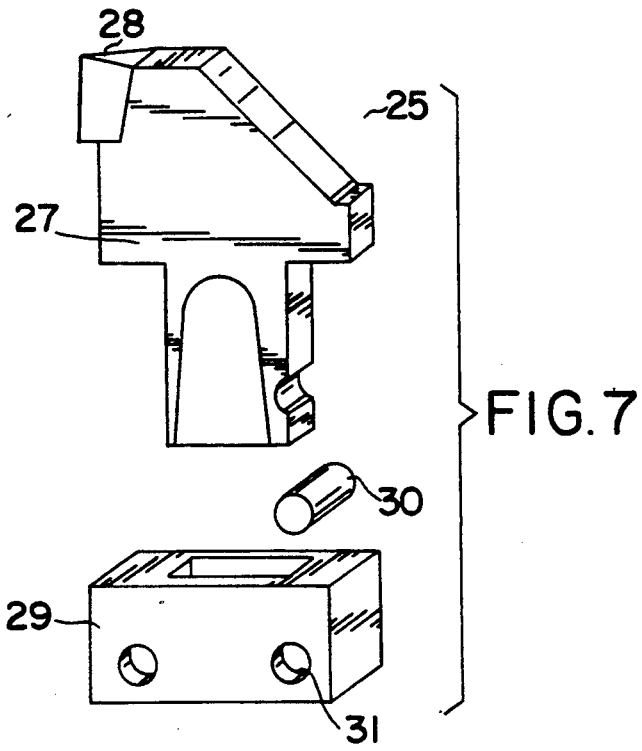
FIG. 7 is a detailed perspective view of a carbide tipped tooth in accordance with the present invention.
Figure 7A:
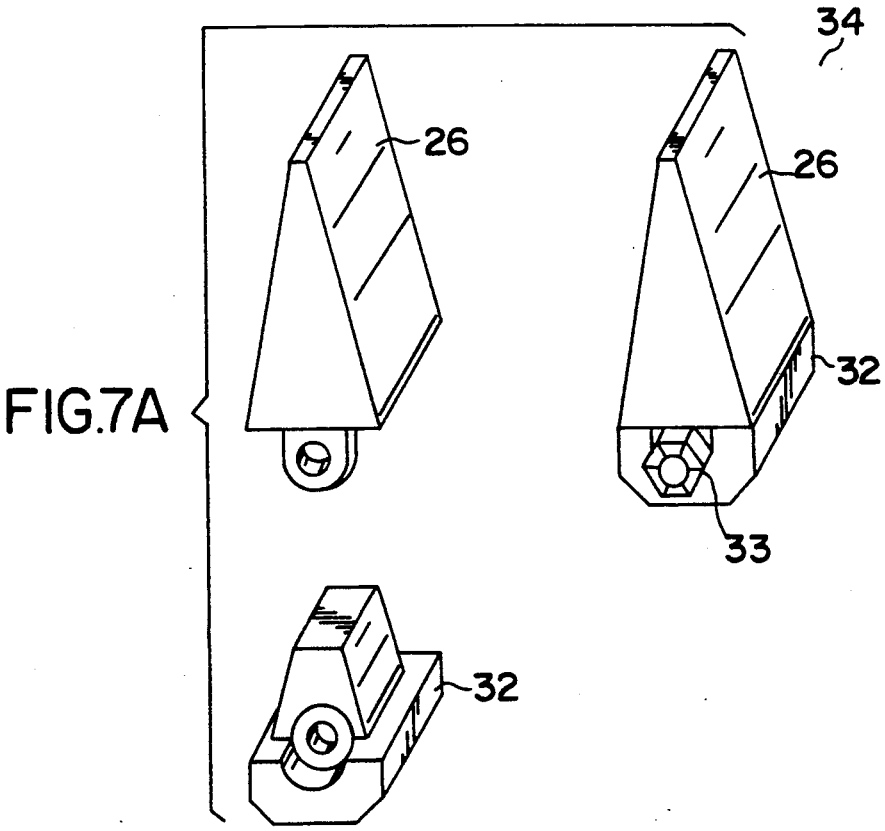
FIG. 7A is a detailed perspective view of a blade in accordance with the present invention.

FIGS. 7 and 7A show in detail the flat blades 26 and the carbide teeth 25 used in this embodiment of the present invention. Carbide tooth 25 consists of a shank 27 that supports a carbide tip 28 which is brazed or otherwise secured upon shank 27. A tooth block 29 is secured as by welding onto a drum 5 as in FIG. 6 and the carbide tooth is held in the block by means of a locking plastic pin 30. Of course, pin 30 could be constructed of any suitable material. By providing two symmetrical holes 31 on the tooth block, the carbide tooth 25 can be inserted and locked either way making the rotor operationally reversible.

Referring to FIG. 7A, flat blade 26 is held onto a blade support 32 by means of bolt and locknut 33 forming the flat blade assembly 34. The blade support 32 is secured as by welding or otherwise to drum 5 as illustrated in FIG. 6, arranging the blades on helical flights. Flat blade 26 which may be hardened and surfaced with tungsten carbide for better abrasion resistance, was specially created for this application and is symmetrical, therefore permitting reversible operation in its original position and does not need to be removed and reinserted as the carbide tooth of this embodiment does.

Figure 8:
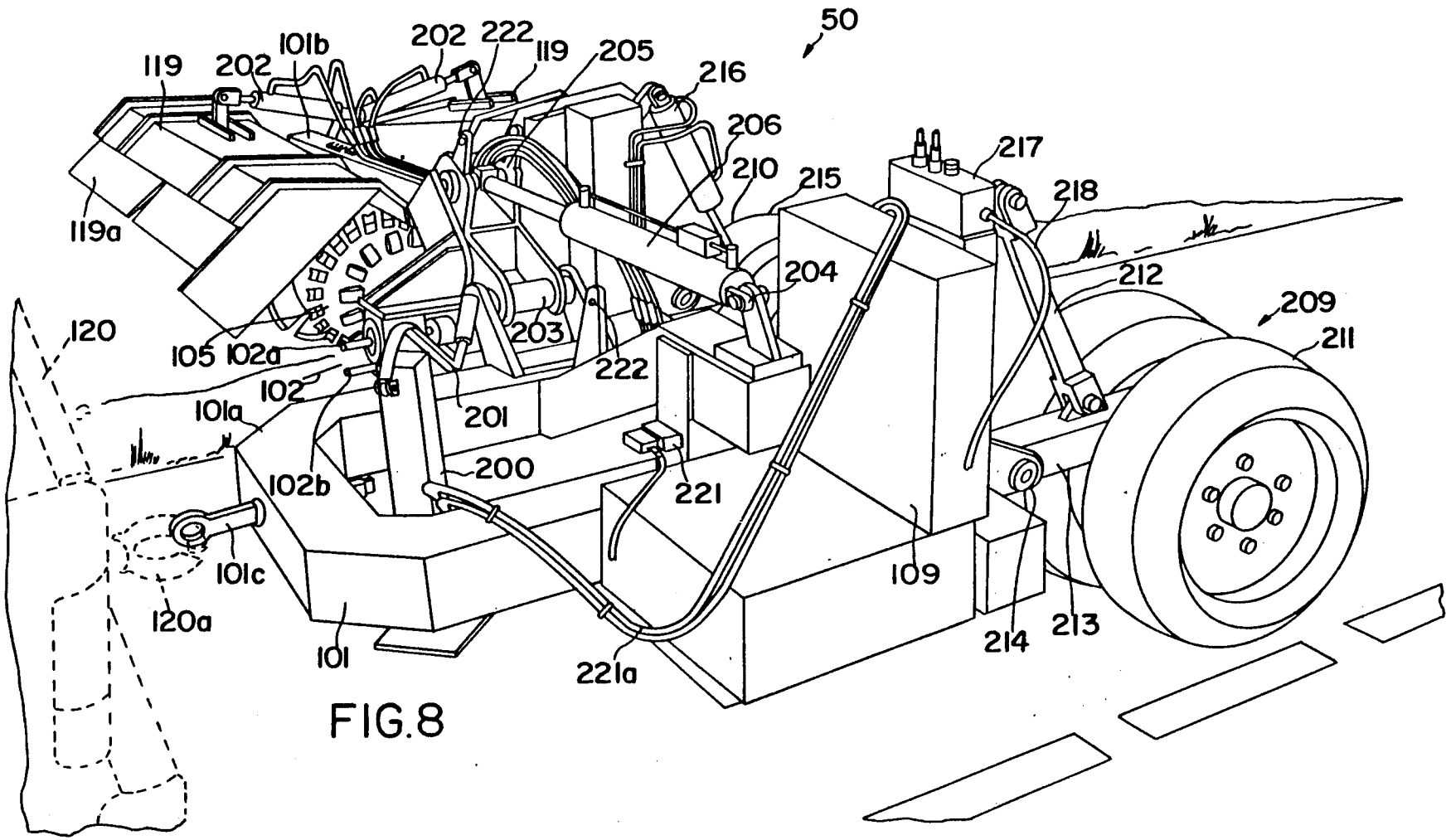
FIG. 8 is a perspective view of yet another embodiment of the present invention.
Figure 9:
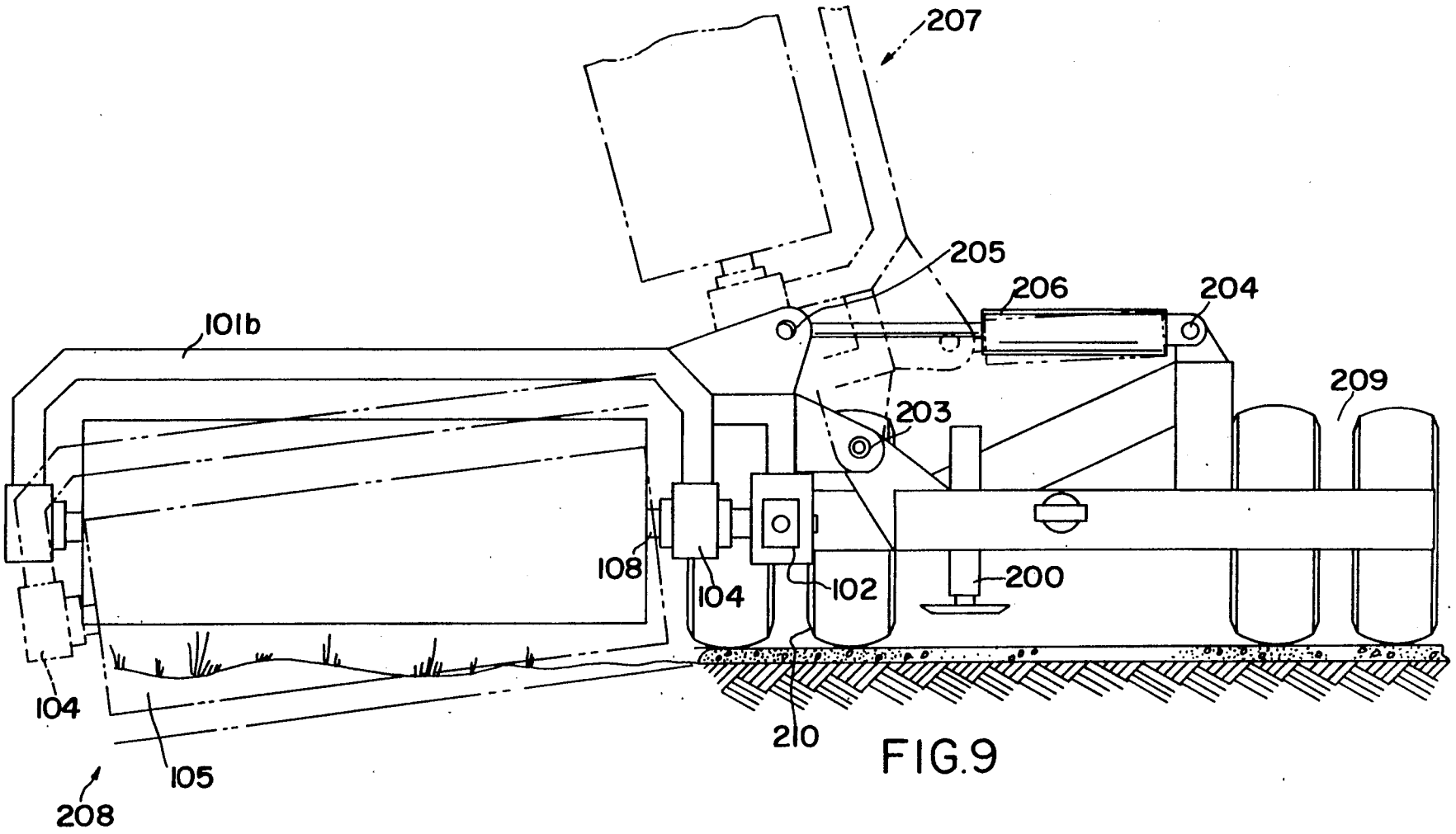
FIG. 9 is a partial front view of the embodiment of FIG. 8.
Figure 10:
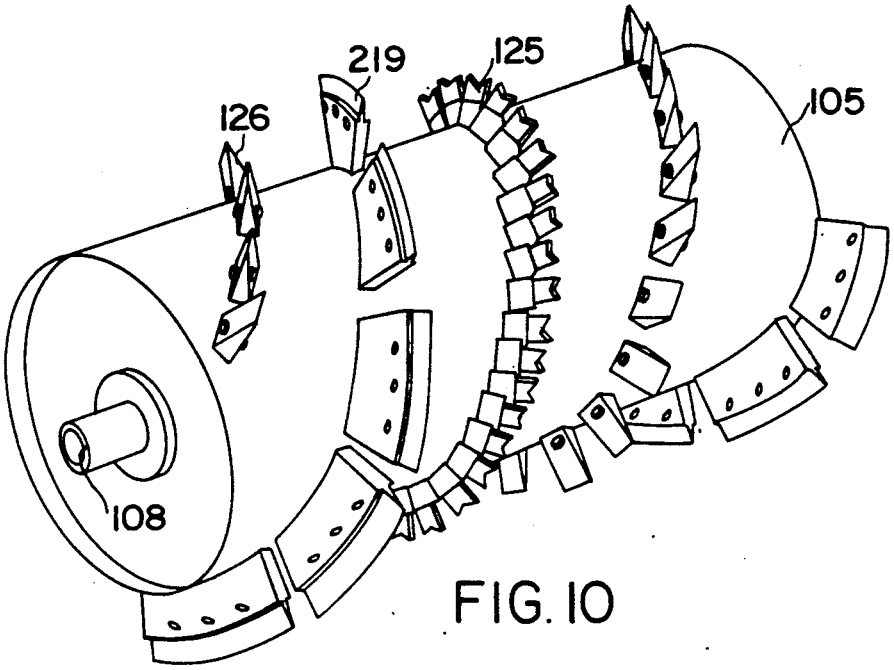
FIG. 10 is a detailed perspective view of another embodiment of a drum or rotor according to the present invention.

Another embodiment of the present invention is illustrated in FIGS. 8-10. A self-contained trailer mount wheeled excavating apparatus is shown generally as 50. As illustrated in FIG. 8, a carrier or prime mover 120, which can be a tractor, truck or any other carrying apparatus, includes a hitch 120a thereon. The excavating apparatus of this embodiment includes a frame 101 which includes a retractable jack stand 200, with a handle 201, for supporting the apparatus when it is not connected to carrier 120. Frame 101 further includes a first substantially U-shaped portion 101a and a second portion 101b pivotally attached to first portion 101a. Frame 101 also includes means for attaching to a carrier vehicle such as illustrated at 101c. Supported on frame 101 is a counterweight 109 for offsetting the weight of the attached cutting means. As embodied herein, the cutting means includes driven rotor 105. Rotor 105 is rotatably connected to the frame second portion 101b. As illustrated in FIG. 9, second frame portion 101b includes bearings such as pillow blocks 104 to support shaft 108 of rotor 105.

Referring further to FIG. 8, second frame portion 101b includes material directing means. As embodied herein, the material directing means includes adjustable deflection panels or flaps 119. Deflection panels or flaps 119 are independently articulatable with respect to second frame portion 101b by cylinders 202 so that the direction of deflection of the cut material can be adjusted by movement of cylinders 202 which in turn controls the location of deflection panels or flaps 119. Flaps 119 may include deformable sections 119a constructed of flexible materials such as rubber or the like.

As illustrated in FIGS. 8 and 9, second frame portion 101b is pivotally connected to first portion 101a at pivotal connection 203. Pivotally attached to first frame portion 101a at 204 and second frame portion 101b at 205 is an adjustable hydraulic cylinder 206. Cylinder 206 can be actuated to articulate second frame portion 101b which carries rotor 105 from a transport position substantially vertical, as illustrated in dotted lines in FIG. 9 at 207, to a working position substantially parallel to the ground surface or at an angle of approximately 30° below horizontal as indicated in dotted lines in FIG. 9 at 208. This arrangement controls the angle of cut of the ground surface by rotor 105. In addition, in the substantially vertical transport position, first portion 101a and second portion 101b can be secured together with locking pins through holes 222 to allow safe transportation on roads when the rotor is in its transportation position.

As illustrated in FIGS. 8 and 9, means for controlling the direction of rotation of the rotatable drum are provided. As embodied herein, a double entry right angle gearbox 102 is utilized to transmit power to rotor 105. Gearbox 102 includes two input shafts, 102a and 102b, and one output shaft. The particular input shaft that is attached to the PTO of the carrier vehicle determines the direction of rotation of the output shaft and therefore the direction of rotation of the rotor 105. If the PTO is connected to one shaft, the output shaft will rotate in a clockwise manner, and if the PTO is connected to the other shaft, the output shaft and, therefore, rotor, will rotate in a counter-clockwise direction. This mechanism is utilized to reverse the direction of the rotor simply by changing the connection between the input shaft of the gearbox and the power take-off. In addition, reversing of the drive direction of rotor 105 could also be accomplished by reversing the direction of fluid flow if a reversible hydraulic motor is employed as a drive source.

First portion 101*a* of frame 101 includes two wheeled structures 209 and 210 that function as a suspension depth control for the apparatus. Wheel structure 209 includes wheels 211 and connecting support members 212 and 213. Connecting member 213 is pivotally attached to frame 101 at 214 and connecting member 212 is also pivotally attached to frame 101. Wheel assembly 210 includes wheels 215, a support member similar to element 213 that pivotally connects the wheel assembly to the frame. Furthermore, wheel assembly 210 includes cylinder 216, instead of a rigid support member like 212, that can be actuated to raise or lower wheel assembly 210. By raising and lowering wheel assembly 210, the height above the ground of the frame and, therefore, the depth of cut into the ground of rotor 105 is controlled. In an alternate embodiment, element 212 may also be a hydraulic cylinder so that wheel assembly 209 can also be articulated.

The entire articulation, including the depth of cut, angle of cut, and orientation of the deflection flaps can be controlled from the carrier through a hydraulic control box 217 that is operatively connected to the hydraulic system through cable 218, which cable is of sufficient length to be able to extend to the carrier when the trailer is in place so as to be operated from the carrier. In addition, an electrohydraulic valve system, illustrated generally at 221, and hydraulic connection lines illustrated generally at 221*a*, are utilized to control the hydraulic functions of the apparatus as would be apparent to one skilled in the art. Cylinder 206 includes a safety lock valve that will lock the cylinder in whatever position it is in if the hydraulic system fails.

As illustrated in FIG. 10, shaft 108 has drum 105 mounted thereon. Drum 105 includes a plurality of helical rows of cutting members. In a preferred embodiment, the cutting members include flat blades generally illustrated at 126, scoop type conveyor blades generally illustrated at 219, and carbide tipped teeth generally illustrated at 125. Flat blades 126, conveyor blades 219 and carbide tipped teeth 125 include support portions that are secured to the drum such as those illustrated at 29 and 32 in FIGS. 7 and 7A.

Figure 11:
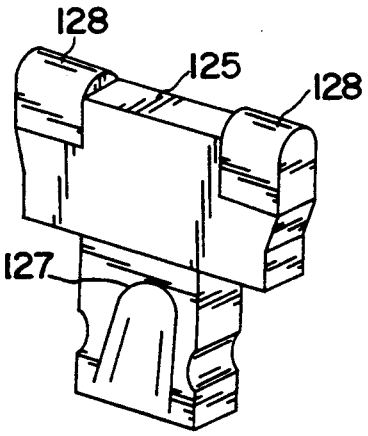
FIG. 11 is a detailed view of a carbide tipped symmetrical tooth of FIG. 10.

As illustrated in FIG. 11, teeth 125 may include carbide tips or blades 128 located symmetrically about the vertical centerline of the tooth so that the tooth can cut in either direction of rotation of the drum 105. In addition, in this embodiment, the tooth 125 includes indentations on both sides of the shank 127 so that the tooth can be secured in the tooth blocks with two pins instead of one as illustrated at 30 in FIG. 7. Obviously, any connection mechanism could be utilized including use of a single bolt or pin through the center of shank 127. In a preferred embodiment, one of the carbide portions 128 on tooth 125 may be slightly higher than the other so that the carbide edge that leads into the ground will cut without the other carbide edge unnecessarily wearing. In such an embodiment, a rocking connection mechanism for the tooth may be required so as to prevent excess wear of the carbide portion that is not cutting in the particular direction of rotation. Such a rocking tooth may include a center pivot connection with a pin such as 30 and a slight taper so that the tooth will rock away from the cutting direction for either direction of rotation.

Figure 12:
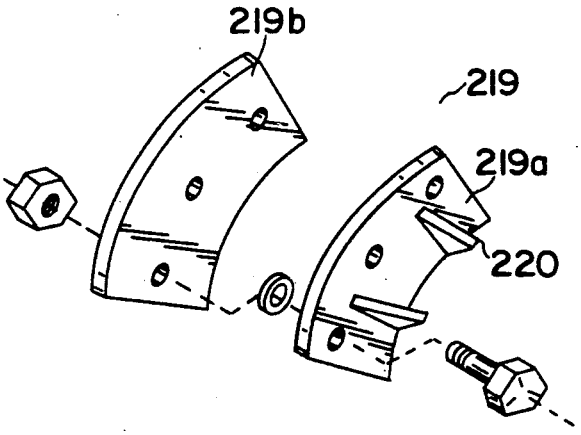
FIG. 12 is a detailed view of a blade as illustrated in FIG. 10.

FIG. 12 illustrates in detail the structure of a preferred embodiment of the scoop type conveyor blades 219. As illustrated in FIG. 12, the conveyor blades include a support portion 219*a* and a material contact portion 219*b*. The support portion 219*a* is welded or otherwise attached to the drum 105 and includes reinforcing members 220. Outer portion 219*b* is bolted or otherwise secured to support portion 219*a*.

As is readily apparent, all of the blades and teeth disclosed in FIGS. 10–12 are substantially symmetrical about their vertical centerlines and supported so that they can cut in either direction of rotation of the drum 105 without adjustment. In addition, the blades and teeth can be constructed from any suitable material and with or without carbide. As can readily be appreciated, the blades and teeth are adapted to be replaceable when worn or if broken.

In a preferred embodiment, blades 126 and teeth 125 extend below the conveyor blades 219 so that cutting contact with the earthen or other material is only made by the blades 126 or teeth 125. Conveyor blades 219 are not adapted to cut, but rather convey the cut material after it has been cut. It is preferred that blades 126 and teeth 125 extend at least ½" and preferably 1 inch below the end of conveyor blades 219.

It should also be apparent that various combinations of flat blades, teeth and conveyor blades, including the elimination of one or more, is within the scope of the present invention. In addition, the helix angle determines the flow of material, and in a preferred embodiment is approximately 45 degrees with respect to the axis of rotor. Of course, various angles may be used depending on the type material cut and the desired result. Further, as used herein, earthen material includes all types of material that might be encountered by an apparatus of this type, including asphalt, small trees and the like. Furthermore, the principles of this invention may have applications for cutting road surfaces or thinning overgrown areas, including but not limited to road widening operations. In addition, the present apparatus can be utilized in any ground condition and is submersible.

Figure 14:
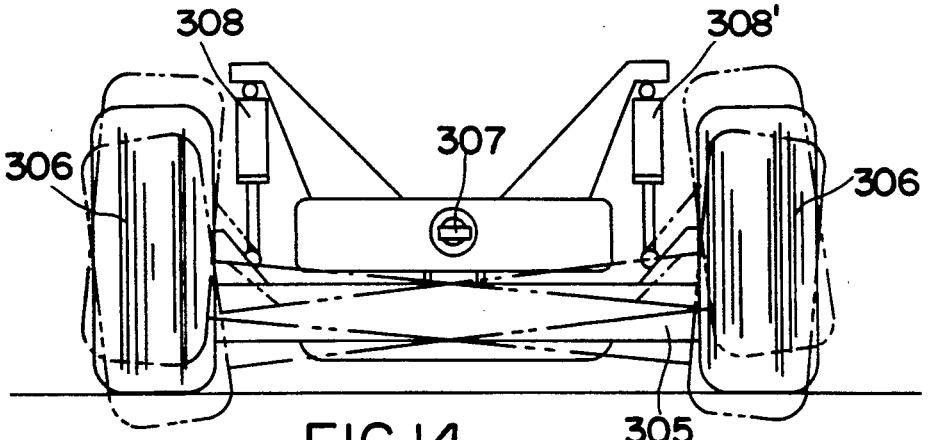
FIG. 14 is a front view of the suspension system of the embodiment of FIG. 13.
Figure 15:
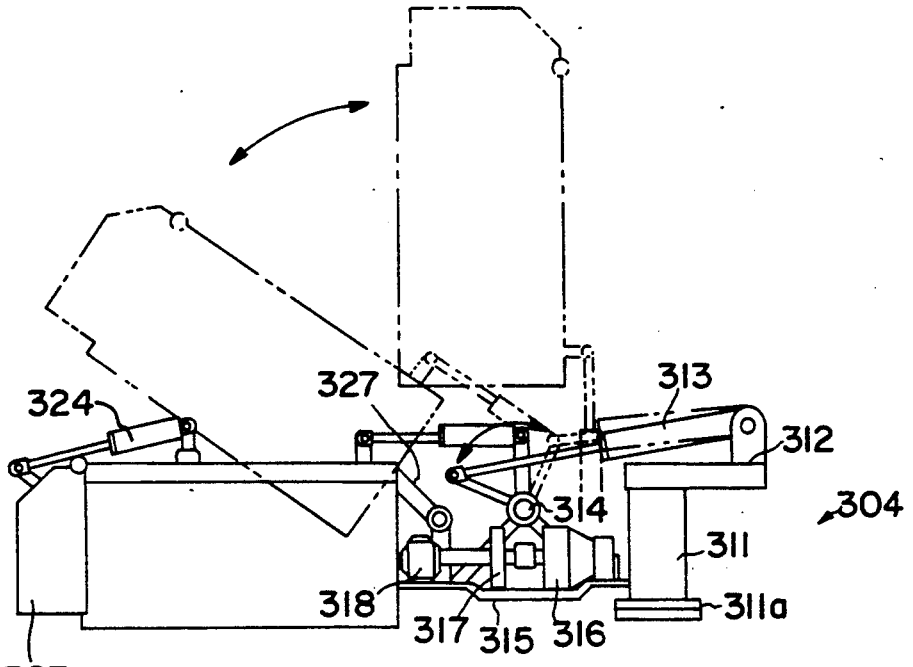
FIG. 15 is a partial front view of the embodiment of FIG. 13 illustrating various positions of the rotor.
Figure 16:
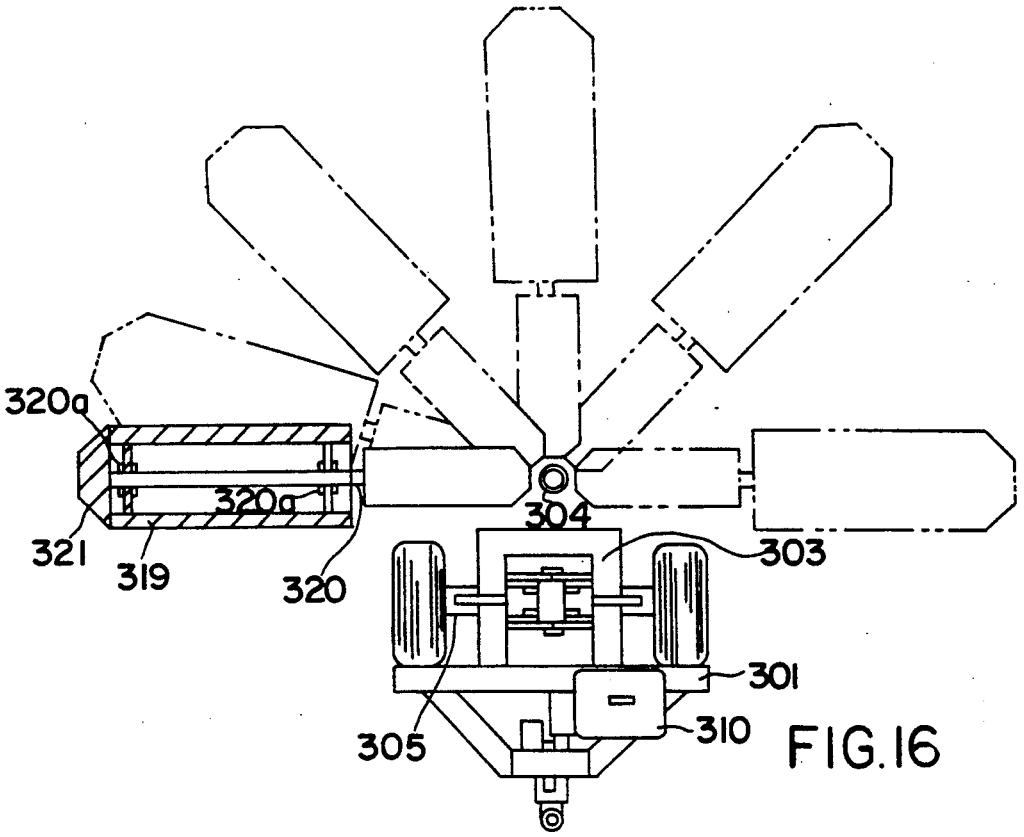
FIG. 16 is a top view of the embodiment of FIG. 13.

Another preferred embodiment of the present invention is illustrated in FIGS. 13–16. Referring first to FIG. 16, the excavating apparatus of this embodiment includes a frame 301 with a counterweight 310 attached thereto. Frame 301 can be constructed of any suitable material as set forth with regard to the previous embodiments. Frame 301 includes wheel support portion 303 and cutting means support portion 304.

Figure 13:
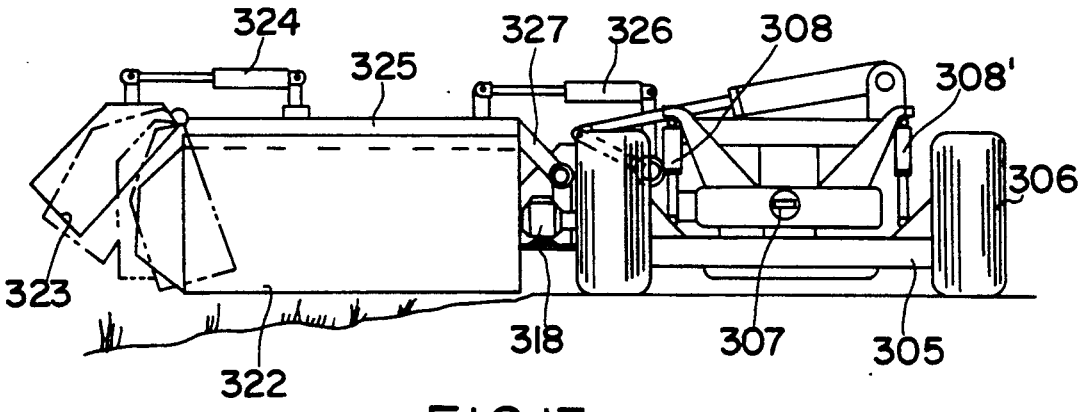
FIG. 13 is a front perspective view of another embodiment of the present invention.

As best illustrated in FIGS. 13 and 14, wheel support portion 303 includes a depth control suspension with axle means 305 connected to wheels 306. Axle means 305 is pivotally connected to wheel support portion 303 about horizontal pivot 307. Pivoting of axle means 305 is controlled by actuation of suspension cylinders 308, 308' and preferably the axle means 305 is arranged so that when one wheel is pivoted down, the other side is pivoted up and vice versa. This pivoting allows for the depth of cutting of the cutting means to be adjusted. As with all embodiments, the depth of cut can be adjusted independent of the angle of cut. The pivotal connection can be by any suitable rod or other means as would be readily apparent to one skilled in the art.

As best illustrated in FIGS. 15 and 16, frame 310 also includes cutting means support portion 304. Cutting means support portion 304 includes a vertical column 311 that includes a rotary actuator such as a motor or drive 311*a* for rotating the column about a vertical axis. Column 311 includes an arm 312 that is adapted to connect to a cylinder 313. Cylinder 313 is pivotably connected to a cutting means assembly positioning pivot 314 which is attached to drive baseplate 315. Drive baseplate 315 carries thereon a gearbox 316 and flange coupling 317. Attached therethrough through a pillow block 318 is the cutting means. As embodied herein, the cutting means includes rotor 319 that is journaled for rotation on shaft 320 by bearings 320*a*. Rotor 319 may include a tapered end portion 321 to allow end cutting.

As best illustrated in FIG. 15, the cutting means and drum baseplate can be pivoted between a position at or below the horizontal to a position substantially vertical above the frame. In addition, as best illustrated in FIG. 16, the cutting means and drive baseplate can be rotated 180° about a vertical axis on column 311 as illustrated in phantom in FIG. 16. This allows the cutting means to be utilized on either side of the frame, as well as allowing the cutting means to be positioned at intermediate angles such as the second phantom illustrates from the left in FIG. 16 for effectively reducing the cutting width of the apparatus. This allows the cutting means to be positioned on either side on the carrier for use on one-way streets and in countries where traffic moves on a side of the road opposite that of the United States. Because of the reversible rotor, the apparatus can be operated in the above manner.

As best illustrated in FIG. 13, deflection means are provided for directing the cut material to a particular location. As embodied herein, the deflection means includes side deflection panels 322 and end deflection panel 323. End deflection panel 323 is pivoted with respect to the cutting means by cylinder 324. Side deflection panels 322 may be pivotally controlled as described with respect to previous embodiments. The deflection panels in the present embodiment are mounted on a panel support frame 325 which may be pivotally controlled by cylinder 326. The panel support frame 325 is pivotally connected to the drive baseplate 315 by arm 327.

The arrangement and type of blades and teeth in the present embodiment, as well as the control and power system are as discussed above with respect to other embodiments of the present invention. In addition, in all embodiments, the power system could be located on the actual trailer and the entire apparatus may be self-propelled.

The arrangement as set forth in this embodiment allows the rotor to be pivoted between a cutting position and a transport position, as well as pivoting partially around the trailer so as to narrow the cutting width of the apparatus, or when rotated to the right hand most position in FIG. 16, to cut on the left side of the road.

These and other modifications and variations of the present invention may be practiced by those of ordinary skill in the art, without departing from the spirit and scope of the present invention, which is more particularly set forth in the appended claims. In addition, features and aspects of the various embodiments can be interchanged in whole or in part in accordance with the present invention. Furthermore, those of ordinary skill in the art will appreciate that the foregoing description is by way of example only, and is not intended to be limitative of the invention so further described in such appended claims.

What is claimed is:

1. An excavating apparatus, said apparatus comprising:

a frame for supporting a cutting means;

cutting means supported by said frame and adapted to cut earthen material, said cutting means comprising a rotatable drum, said rotatable drum including at least one helical row of blades attached to said drum and at least one helical row of teeth attached to said drum so that earthen material can be cut and conveyed by the excavating apparatus, and further comprising material directing means pivotally connected to said frame to direct the cut earthen material, said material directing means including a plurality of independently adjustable deflection panels operatively associated with said cutting means so that the cut earthen material can be directed in a particular direction.

2. An excavating apparatus, said apparatus comprising:

a frame for supporting a cutting means;

cutting means supported by said frame and adapted to cut earthen material, said cutting means comprising a rotatable drum, said rotatable drum including at least one helical row of blades attached to said drum and at least one helical row of teeth attached to said drum so that earthen material can be cut and conveyed by the excavating apparatus;

wherein said apparatus includes means driving the rotatable drum and means for reversibly controlling the direction of rotation of the rotatable drum; and wherein said means for controlling the direction of rotation of the rotatable drum includes a double entry gearbox.

3. An excavating apparatus, said apparatus comprising:

a frame for supporting a cutting means, said frame including a first portion and a second portion, said second portion being pivotally attached to and laterally spaced with respect to the direction of movement of the apparatus from said first portion so that the second portion can be raised and lowered with respect to the first portion and so that said first portion can be moved along a road and said second portion will move in the same direction and laterally spaced from said first portion for cutting a road shoulder or the like;

cutting means supported by said second portion of the frame and adapted to cut earthen material, said cutting means comprising a rotatable drum, said rotatable drum including a plurality of helical rows of cutting members; and material directing means pivotally connected to said frame to direct the cut earthen material, said material directing means including at least one adjustable deflection panel operatively associated with said cutting means so that the cut earthen material can be directed in a particular direction.

4. An excavating apparatus as in claim 3, wherein said material directing means includes a plurality of independently adjustable deflection panels so that cut earthen material can be directed in a particular direction.

5. An excavating apparatus as in claim 3, wherein said cutting means is adjustable to control the depth of cut in the earthen material.

6. An excavating apparatus as in claim 3, wherein said cutting means is adjustable to control the angle of cut into the earthen material.

7. An excavating apparatus as in claim 3, wherein said rotatable drum includes at least one helical row of blades and one helical row of carbide tipped teeth, and wherein said blades and teeth are substantially symmetrical so that the rotatable drum can be rotated either clockwise or counter-clockwise.

8. An excavating apparatus, said apparatus comprising:

a frame for supporting a cutting means, said frame including a wheel support portion and a cutting means support portion, said cutting means support portion being pivotal about a vertical axis from a position locating said cutting means substantially perpendicular to the direction of movement of the apparatus on one side of the apparatus to a position substantially perpendicular to the direction of movement of the apparatus on the opposite side of the apparatus; and cutting means supported by said cutting means support portion and adapted to cut earthen material, said cutting means comprising a rotatable drum including a plurality of helical rows of cutting members.

9. An excavating apparatus as in claim 8, and further including material directing means for directing the cut earthen material in a particular direction.

10. An excavating apparatus as in claim 9, wherein material directing means includes an end deflector panel.

11. An excavating apparatus as in claim 8, wherein said wheel support portion of said frame includes a suspension pivotable about a horizontal pivot axis, said suspension being adapted to adjust the depth of cut of the cutting means.

12. An excavating apparatus as in claim 8, wherein said cutting means support portion is pivotal 180° about said vertical axis so that said cutting means can be positioned on either side of said excavating apparatus or at intermediate positions.

13. An excavating apparatus as in claim 8, wherein said rotatable drum includes at least one helical row of conveyor blades and one helical row of cutting blades.

14. An excavating apparatus as in claim 13, wherein said cutting blades extend below said conveyor blades.

15. An excavating apparatus, said apparatus comprising:

a frame for supporting a cutting means;

cutting means supported by said frame and adapted to cut earthen material, said cutting means comprising a rotatable drum, said rotatable drum including at least one helical row of blades attached to said drum and at least one helical row of teeth attached to said drum so that earthen material can be cut and conveyed by the excavating apparatus; and material directing means pivotally connected to said frame to direct the cut earthen material, said material directing means including a plurality of independently adjustable deflection panels that are independently adjustable with respect to each other so that the cut earthen material can be directed in a particular direction.

16. An excavating apparatus, said apparatus comprising:

a frame for supporting a cutting means;

cutting means supported by said frame and adapted to cut earthen material, said cutting means comprising a rotatable drum, said rotatable drum including at least one helical row of blades attached to said drum and at least one helical row of teeth attached to said drum so that earthen material can be cut and conveyed by the excavating apparatus; and wherein said apparatus includes means driving the rotatable drum and means for reversibly controlling the direction of rotation of the rotatable drum.

* * * * *